US011418871B2

(12) United States Patent
Krüger

(10) Patent No.: US 11,418,871 B2
(45) Date of Patent: Aug. 16, 2022

(54) MICROPHONE ARRAY

(71) Applicant: Sennheiser electronic GmbH & Co. KG, Wedemark (DE)

(72) Inventor: Alexander Krüger, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 17/051,242

(22) PCT Filed: May 6, 2019

(86) PCT No.: PCT/EP2019/061529
§ 371 (c)(1),
(2) Date: Oct. 28, 2020

(87) PCT Pub. No.: WO2019/211487
PCT Pub. Date: Nov. 7, 2019

(65) Prior Publication Data

US 2021/0235187 A1 Jul. 29, 2021

(30) Foreign Application Priority Data

May 4, 2018 (DE) ..... 102018110759.5

(51) Int. Cl.
*H04R 1/32* (2006.01)
*H04R 3/00* (2006.01)

(52) U.S. Cl.
CPC ..... *H04R 1/326* (2013.01); *H04R 3/005* (2013.01); *H04R 2201/401* (2013.01); *H04R 2203/12* (2013.01); *H04R 2430/23* (2013.01)

(58) Field of Classification Search
CPC .. H04R 1/326; H04R 3/005; H04R 2201/401; H04R 2203/12; H04R 2430/23
USPC ..... 381/56, 58, 91, 92, 122, 362, 390
See application file for complete search history.

(56) References Cited

U.S. PATENT DOCUMENTS

2005/0195988 A1* 9/2005 Tashev ..... H04R 3/005 381/92
2007/0118360 A1* 5/2007 Hetherington ..... G10L 21/0208 704/E21.003

(Continued)

FOREIGN PATENT DOCUMENTS

EP 1 538 867 6/2005
EP 3188504 A1 * 7/2017 ..... G09G 5/003

(Continued)

OTHER PUBLICATIONS

Search Report for Application No. PCT/EP2019/061529 dated Jul. 12, 2019.

(Continued)

*Primary Examiner* — William A Jerez Lora
(74) *Attorney, Agent, or Firm* — Haug Partners LLP

(57) ABSTRACT

For certain application cases, such as e.g., in a sports stadium, a microphone array having a particularly high directivity in the vertical direction and a high, yet in wide limits adjustable directivity in horizontal direction is provided. The microphone array has a plurality of microphones whose output signals are combined into at least one common output signal. The microphones are directional microphones with a preferred direction of high sensitivity and arranged substantially in one plane on a circle or segment of a circle, such that each microphone has a different direction of high directivity. For each of the microphones, the preferred direction of high sensitivity is substantially orthogonal to the circle or segment of the circle. A common output signal of the microphone array is obtained by beamforming. The microphone array has an adjustable preferred direction of high sensitivity, wherein the common output signal comprises the sound recorded from this adjustable direction.

15 Claims, 6 Drawing Sheets

(56) References Cited

U.S. PATENT DOCUMENTS

| | | | | |
|---|---|---|---|---|
| 2012/0076316 | A1 | 3/2012 | Zhu et al. | |
| 2013/0315404 | A1* | 11/2013 | Goldfeder | H04R 3/005 381/92 |
| 2017/0076720 | A1 | 3/2017 | Gopalan et al. | |
| 2018/0286433 | A1* | 10/2018 | Hicks | G10L 21/0232 |

FOREIGN PATENT DOCUMENTS

| | | | |
|---|---|---|---|
| JP | H0572025 | A * | 3/1993 |
| WO | WO 2009/009568 | | 1/2009 |
| WO | WO 2014/083542 | | 6/2014 |
| WO | WO 2015/013058 | | 1/2015 |

OTHER PUBLICATIONS

Renato S. Pellegrini et al., "Object-Audio Capture System for Sports Broadcast" Sep. 27, 2018 (Sep. 27, 2018). Retrieved from the Internet: https://www.ibc.org/download?ac=6529 [retrieved on Jul. 2, 2019] XP055601525.

Niwa et al., Binaural sound generation corresponding to omnidirectional video view using angular region-wise source enhancement, 2016 IEEE International Conference on Acoustics, Speech and Signal Processing (ICASSP), Mar. 20, 2016.

Yo Sasak et al., Electroacoustics and Audio Engineering: Paper ICA2016-155 Development of multichannel single-unit microphone using shotgun microphone array, In: 22nd International Congress on Acoustics—Sep. 5-9, 2016—Buenos Aires, 2016.

* cited by examiner

MICROPHONE ARRAY

CROSS-REFERENCE TO RELATED APPLICATIONS

This application is the National Stage entry under 35 U.S.C. § 371 of International Application No. PCT/EP2019/061529 filed May 6, 2019, published as Publication No. WO 2019/211487 on Nov. 7, 2019, which claims benefit of foreign priority of German Patent Application No. 10 2018 110 759.5, filed on May 4, 2018, the entireties of which are herein incorporated by reference.

FIELD OF DISCLOSURE

The invention relates to a microphone array.

BACKGROUND

For sound recordings in large sports facilities, the acoustic events on the field may be particularly interesting for an immersive playback, such as noise from the ball, the bat or racket and so forth as well as conversations of the players, umpire or referee, trainers and so forth. Due to the amount of ambient noise, it is difficult to achieve a good sound quality and speech intelligibility. This has to do with the fact that microphones often have to be positioned on the edge of the field, because a large distance to the desired sound sources needs to be maintained. The disturbing noise comprises substantially noise of the audience, which in sports facilities is normally found in the spectator stands. Moreover, the microphones for sound recording should not block the view for the spectators or the usually present cameras.

A typical example is the playing field of a soccer stadium, wherein ball noises, player conversations, whistling of the referee and trainer instructions should be captured.

Similar problems may occur in other sports, such as, e.g., baseball, or in other situations where sound recordings are to be made from sound sources that are widely distributed over a plane area and that may be mobile and cannot be directly provided with a microphone, despite disturbing ambient noise.

A solution from LAWO that is known as "KICK" is an arrangement of numerous directional microphones or microphones having a super-cardioid characteristic, which are distributed around a soccer field on the edge of the field, parallel to the ground (https://www.lawo.com/en/products/audio-production-tools/kick.html). For capturing ball noises, the ball position is visually tracked, automatically or semi-automatically. The position data are input into an automatic audio mixing unit that receives also the microphones' output signals, processes or weights them respectively according to the position data and mixes them. The idea behind is that signals from microphones that are closest to the current ball position are particularly weighted. A disadvantage of this known solution is that a large amount of cabling is required. The cables and the microphones must be laid before each game and removed again after the game. Additional microphones require additional cabling and make the system more expensive. Further, due to the fixed alignment of the microphones, their optimally captured region must be relatively wide in order to cover also regions in between neighboring microphones. Nevertheless, these regions are captured with only poor sound quality and therefore suboptimal. Additionally, a larger coverage area of the microphones in the plane (azimuth angle) leads to an increase in the vertical coverage area (elevation angle), since the directional characteristics (i.e., beam patterns) of known microphones are rotationally symmetric. This means that noises from the higher spectator stands are also captured.

Another possible solution consists in a manual alignment or tracking of directional microphones with a particularly high directivity. However, this is associated with a time delay. Moreover, service personnel for each directional microphone is required in the case of manual alignment, and structure-borne noise can be transferred to the microphone. With a possible remote control for aligning the microphones, both additional delay and motor noise would occur, which would inevitably be captured by the microphone and be hearable as disturbing noise. An incorrect alignment of a directional microphone affects different frequencies differently, since the directivity of the directional microphones is stronger for higher frequencies than for lower. This leads to a permanently changing tone or timbre of the sound signal.

Another known solution for achieving a high directional effect is beamforming, where output signals of a plurality of microphones arranged as an array are combined, e.g., using delay, addition and filtering. The resulting beam, i.e., the region of particularly high sensitivity, has an adjustable direction and is usually rotationally symmetric. The respective shape of the beam depends on the type, number and arrangement of the microphones as well as on the algorithm that is used for the combining. Common algorithms are the Delay-and-Sum (DS) algorithm and the "Minimum Variance Distortionless Response" (MVDR) algorithm, which both have drawbacks, however. Normally, microphone arrays are constructed from microphones without or with low directivity, since they are easy to handle and cheap. This requires a very large number of microphones for obtaining a high directivity over a wide azimuth angle and a similar directivity with respect to elevation, leading to a high computation effort.

It is therefore an object of the present invention to provide a microphone arrangement that solves the above-mentioned problems.

For multi-channel audio recording, e.g., for 22 channels, an arrangement with shotgun microphones arranged on a circle is known (Y. Sasaki, T. Nishiguchi, K. Ono: "Development of multichannel single-unit microphone using shotgun microphone array"). Neighboring shotgun microphones are used for additionally narrowing the rotationally symmetric directivity pattern (or beam pattern) of each single shotgun microphone at low frequencies to the respective direction by filtering. In another known solution (K. Niwa, Y. Koizumi, K. Kobayashi, H. Uematsu: "Binaural sound generation corresponding to omnidirectional video view using angular region-wise source enhancement"), shotgun microphones are used as an alternative to beamforming.

SUMMARY OF INVENTION

An object of the present invention is to provide a microphone arrangement with a particularly high directivity in vertical direction and a high yet in wide limits adjustable directivity in horizontal direction.

This object is achieved by the microphone array according to claim 1.

According to the invention, a microphone array comprises a plurality of microphones whose output signals are combined into at least one common output signal, wherein the microphones are shotgun microphones arranged with a preferred direction of high sensitivity. Further, the microphones are arranged essentially evenly on a circle or segment of a circle such that each of the microphones has another preferred direction of high sensitivity, wherein preferably the angles between the individual microphones are substantially equal over the entire circle or segment. The microphones may point inwardly or outwardly with respect to the circle or circle segment. In one embodiment, all microphones are arranged substantially in one plane. In another embodiment, the microphones are arranged in multiple, e.g., two or three, parallel and adjacent planes. The thickness of each plane may correspond to about the diameter of a microphone or interference tube, respectively. The common output signal of the microphone array is obtained by beamforming.

Due to the high directivity of the shotgun microphones, both the elevation angle and the azimuth angle of the detection area or coverage of the arrangement are very small, while the azimuth angle is adjustable in a very large range that may be up to 360°. The resulting azimuthal directivity of the microphone arrangement can be stronger than the directivity of a single shotgun microphone, even if none of the shotgun microphones points to the respective direction. In embodiments where the microphones are distributed over a full circle, there are always some shotgun microphones that point opposite to the actual target direction. This enables a constant directivity, regardless of the orientation of the microphone array.

A method for audio recording by means of shotgun microphones is disclosed in 12. Further advantageous embodiments are disclosed in the claims 2-11, 13-14 and in the following detailed description.

BRIEF DESCRIPTION OF THE DRAWINGS

Further details and advantageous embodiments are depicted in the drawings in which.

DETAILED DESCRIPTION

Figure 1:
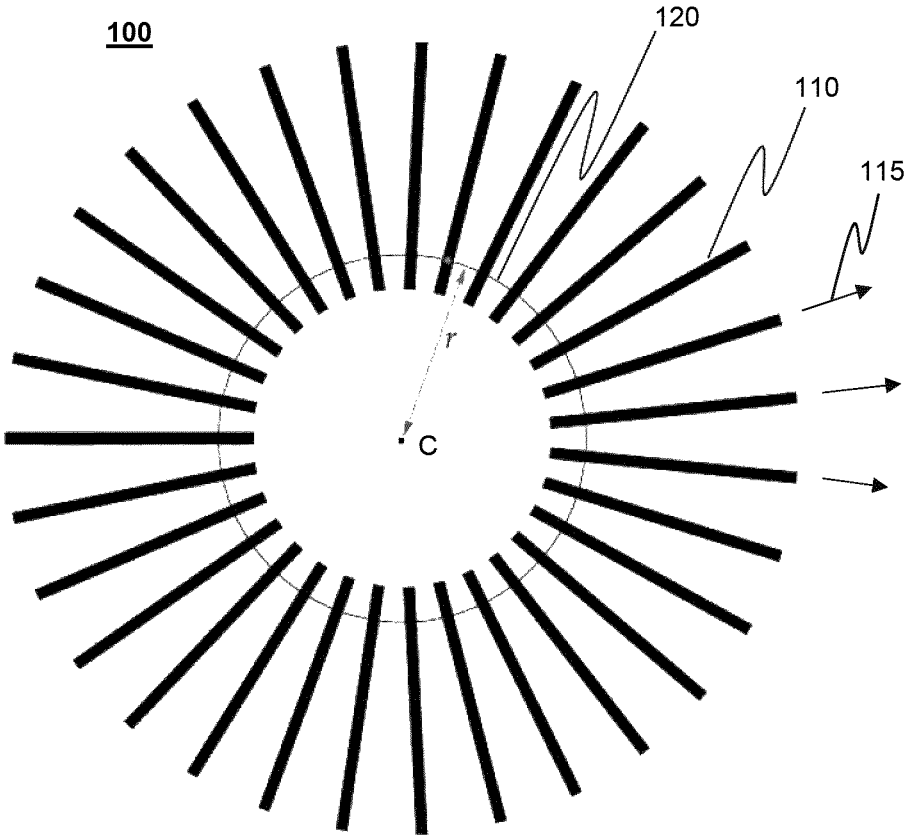
FIG. 1 shows a microphone array in a first embodiment.

FIG. 1 shows exemplarily, in one embodiment of the invention, a circular microphone array 100 with thirty-one directional microphones 110, wherein the microphone array 100 as well as each individual directional microphone 110 have a very high directivity. Each of the directional microphones 110 comprises a microphone capsule, wherein the microphone capsules of all directional microphones 110 are arranged on a circle 120 with a radius r around a center C. Further, each of the directional microphones 110 comprises an interference tube that is disposed orthogonally relative to the circle 120 and is directed radially outwardly. The interference tube ensures the directional characteristic of the respective directional microphone. The microphones are therefore also called shotgun microphones. The preferred direction of high sensitivity of each shotgun microphone is in its respective longitudinal direction, thus also orthogonally relative to circle 120 or, respectively, radially relative to the overall arrangement. Thus, each microphone has a different preferred direction of high sensitivity. The shotgun microphones are distributed over the circle essentially uniformly, so that equal angles are between the microphones respectively, e.g., $360°/31 \approx 11.6°$. Further, all shotgun microphones may be arranged in a common plane, in one embodiment. The entire arrangement is positioned substantially horizontally, e.g., in a soccer stadium, such that the shotgun microphones are aligned parallel to the ground.

Alternatively, the shotgun microphones may be arranged in two or more different planes. These planes should preferably be close to each other. In principle, the microphones may also be arranged in different planes, but the sensitivity of all microphones with regard to a defined elevation should then be similar. In other words, the "view angles" or focus regions of the various microphones should all be substantially in one plane in an intended distance.

The radius of the circle 120 or circle segment determines the alias frequency and the operating frequency range. A larger radius, at a constant number of directional microphones, results in improvements for low frequencies, by leading to a shift of this range to lower frequencies and leading to a lower alias frequency. Increasing the number of microphones results in a higher alias frequency.

Figure 2:
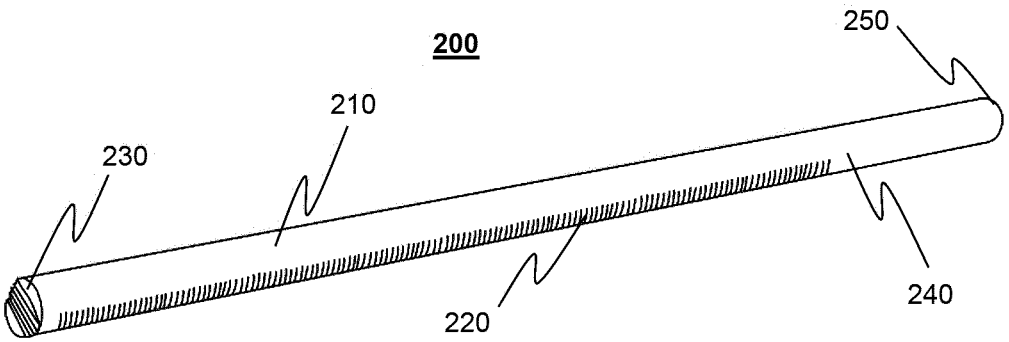
FIG. 2 shows a shotgun microphone having an interference tube.

FIG. 2 shows exemplarily a single shotgun microphone 200 that may be used as directional microphone 110 in the arrangement 100. The shotgun microphone 200 comprises a tube 210 acting as an interference tube with a microphone capsule 240 disposed therein (not visible in the drawing). The microphone capsule may be electrically connected via electrical connectors 250 at the rear end of the shotgun microphone. The interference tube 210 comprises in this example at its front end one or more openings 230 serving for sound entrance. Disposed laterally and distributed over the length of the tube there are further openings 220 that allow also laterally arriving sound to pass into the tube. This laterally arriving sound may enter the tube also through the openings 230, but it is phase-shifted due to the longer path. In the tube, it is superimposed with the lateral sound coming in through the side openings 220. Due to interference within the tube, this sound is therefore compensated, so that a lower sensitivity for laterally arriving sound results. Only for frontally arriving sound the components that enter the tube through openings 220, 230 are constructively superimposed, which leads to a higher sensitivity of the microphone for the frontally arriving sound ("endfire shotgun microphone"). The side openings 220 of the interference tube are normally not distributed over its circumference, but are located on only one side which is referred to as upper side of the shotgun microphone in the following.

Shotgun microphones afford the advantage of a particularly high directivity, which relates both to a very small azimuth angle as well as a very small elevational angle. The elevational angle is the angle perpendicular to the drawing plane in FIG. 1. Although the azimuth angle, i.e., the angle in the drawing plane of FIG. 1, of each individual shotgun microphone is also very small, a directivity of the entire arrangement in the plane can be controlled by including adjacent shotgun microphones and performing suitable calculations for combining the different microphone signals. In particular, the directivity of a rotationally symmetrical arrangement as in FIG. 1 can be electronically controlled to any direction of the plane, i.e., to any azimuth angle. The elevational angle of the directivity or beam pattern of the entire arrangement is the same as the elevational angle of the directivity or beam pattern of each individual shotgun microphone, i.e., very small. Thus, it is not necessary to arrange microphones in a plurality of vertical planes for obtaining a high vertical directivity. This allows a flat arrangement, which e.g., in a sports stadium does not disturb the spectators' or cameras' view if the microphone array is positioned at the edge of the playing field. Further, no calculations for a combination (which is possibly time-varying) of the microphone signals over the vertical axis are required.

A further advantage of a rotationally symmetrical arrangement as in FIG. 1 is that the directivity as well as the frequency characteristic is uniform in any direction of the plane, i.e., to any azimuth angle. Therefore, no sound coloration of laterally arriving sound occurs, such as e.g., noise from the audience, if the direction of high sensitivity of the arrangement is changed. Moreover, it is easy to define multiple directions simultaneously as directions of high sensitivity by multiple parallel different processing of the microphone signals. This allows the beam to be focused to multiple azimuth angles simultaneously, i.e., multiple sound sources may be recorded from different directions simultaneously with high directivity.

Various methods of signal processing may be used. A possible and particularly advantageous signal processing for the microphone array is the beamforming algorithm. Here, the beamforming is based on the so-called modal beamforming, which is especially suitable for configurations where all microphones have essentially the same directivity (directional effect) and are arranged on a sphere or on a circle. For the operating frequency range of the array it is possible to achieve an almost uniform directivity over all frequencies of the operating frequency range. The number Q of microphones used determines the maximum achievable degree M of the output signal, which corresponds to the spatial resolution of the beam pattern, according to $$M \leq \left\lfloor \frac{Q-1}{2} \right\rfloor.$$

The processing is effected in two steps: (a) frequency-independent mixing (or matrixing) of the microphone signals to obtain 2M+1 intermediate signals or mixed signals, and (b) filtering and then weighting and summing of the intermediate signals or mixed signals.

Figure 7:
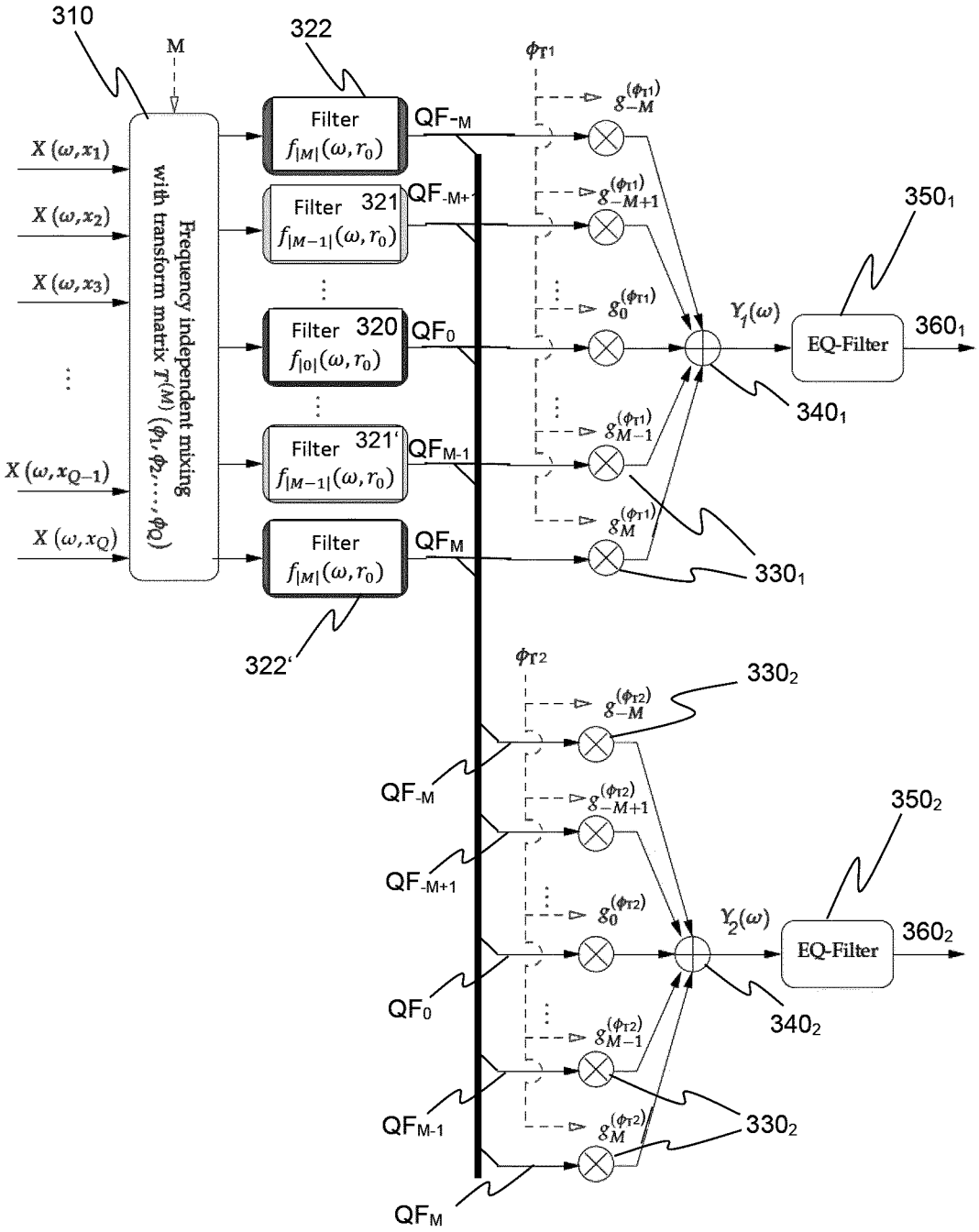
FIG. 7 shows a block diagram of a multi-focus signal processing for the beamforming algorithm.

What is especially remarkable is the option to accomplish directing the beam (i.e., steering the resulting direction of high sensitivity) to a target azimuth angle $\Phi_T$ by accordingly recomputing the real values weights $g_m^{(\Phi_T)}$. The steering (i.e., providing information about the target azimuth angle $\Phi_T$) may be done either manually or automatically, e.g., by a visual tracking system. It is of particular importance that the actual steering of the microphone array is accomplished electronically, i.e., contactlessly, and that the steering information is time-variant. Further, the filtered signals are weighted correspondingly before summation, which eases simultaneous recording of multiple sound sources as targets. An example is shown in FIG. 7 and explained hereinafter.

Figure 3:
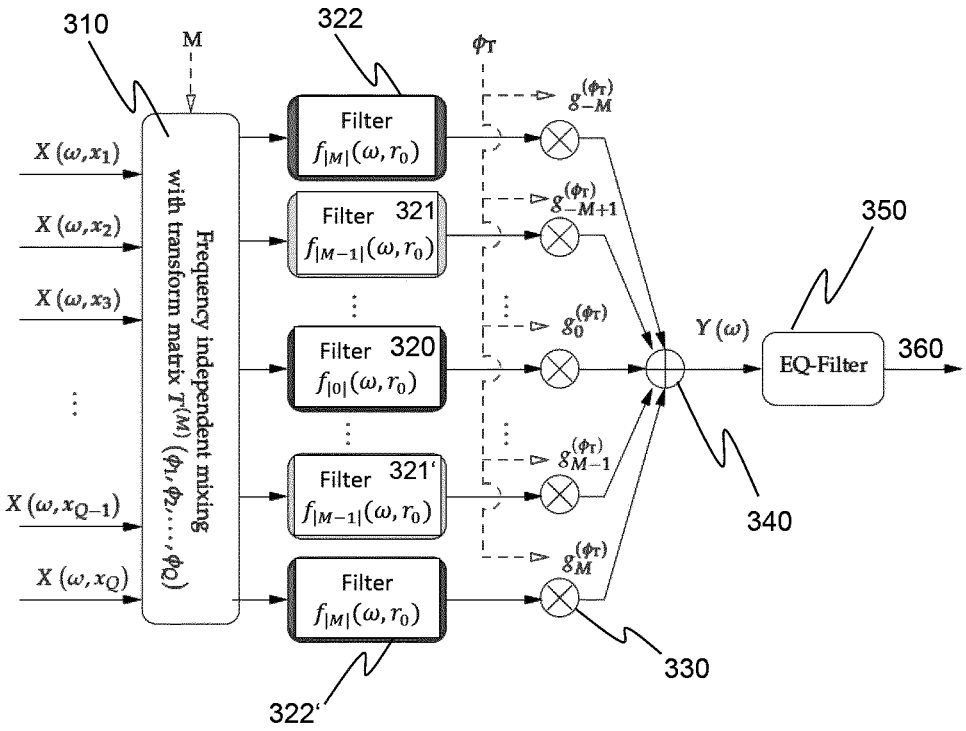
FIG. 3 shows a block diagram of a signal processing for the beamforming algorithm.

FIG. 3 shows a block circuit diagram of signal processing for the modal beamforming algorithm for an array of directional microphones arranged on a circle. The Q microphone signals $X(\omega,x_1), \ldots, X(\omega,x_Q)$ are mixed in a transformation matrix $T^{(M)}(\phi_1, \phi_2, \ldots \phi_Q)$ 310 in a frequency-independent manner. The transformation matrix is valid for a desired maximum degree $$M \leq \left\lfloor \frac{Q-1}{2} \right\rfloor$$

and provides (2M+1) output signals. Each output signal is filtered, wherein one filter 320 of the (2M+1) filters 320, . . . , 322' occurs once and all others occur twice as equal filter pairs 321, 321'. E.g., the filter 321 for the $(-M+1)^{th}$ matrix output and the filter 321' for the $(M-1)^{th}$ matrix output are equal. Each filter or filter pair respectively has its own filtering function, corresponding to an order of a particular mode. The output signal of each filter 320, . . . , 322' is weighted in one or more weighting units 330 according to the desired azimuthal direction $\Phi_T$ with a corresponding gain value $g_{-M}^{(\Phi_T)}, g_{-M+1}^{(\Phi_T)}, \ldots, g_M^{(\Phi_T)}$. The 2M+1 weighted filtered mixed signals are summed up in a summation unit 340, and the sum signal $Y(\omega)$ can then be either provided as output signal 360, or optionally filtered in an equalization filter 350 and then output. Thus, a very flexible time-variant beamforming is possible.

For the number of directional microphones and their positions, the following applies. In general, the number of microphones determines the spatial resolution of the achievable target beam pattern or directional characteristic, in particular the maximum directivity index, which is the ratio between the beamformer's output power with respect to a desired target direction and the total output power integrated over all other directions. In the context of modal beamforming, it is useful to choose the number Q of microphones in dependence of the required maximum degree M according to Q=2M+1. If the Circular Harmonics transform described below is used, then it is advantageous, in consideration of the assumptions made for it, to use a uniform distribution of microphones on a circle. This ensures a uniform signal quality over all (azimuthal) directions, as intended with modal beamforming.

Figure 4:
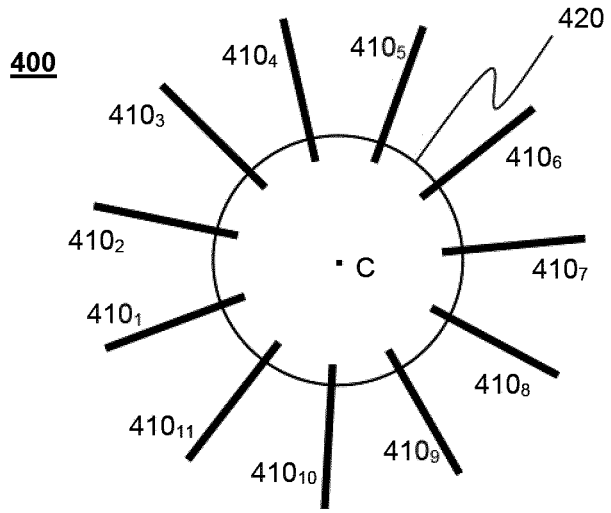
FIG. 4 shows a microphone array in a second embodiment.

FIG. 4 shows a microphone array 400 in a second embodiment. Eleven directional microphones $\mathbf{410}_1, \ldots, \mathbf{410}_{11}$ are arranged radially distributed uniformly over a circle 420. According to Q=2M+1 with Q=11, a signal with a degree of at most M=5 can be generated.

Figure 5:
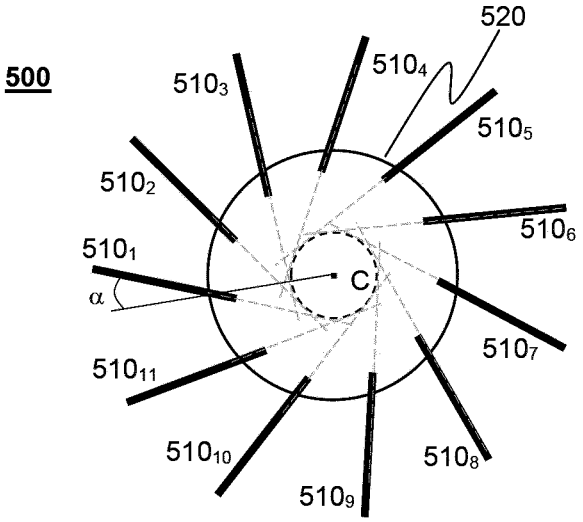
FIG. 5 shows a microphone array in a third embodiment.

If another algorithm than modal beamforming is used, it may however be appropriate to arrange the directional microphones differently, namely not exactly radially but slightly rotated or displaced, respectively. This makes the overall arrangement smaller, without reducing the length of the individual directional microphones or the diameter of the circle of microphone capsules. FIG. 5 shows a microphone array 500 in a third embodiment, where each of the eleven microphones $\mathbf{510}_1, \ldots, \mathbf{510}_{11}$ is rotated through an angle $\alpha$ with their microphone capsules being arranged on a circle 520. The algorithm used must consider this rotation, wherein very small angles can be neglected.

Figure 6:
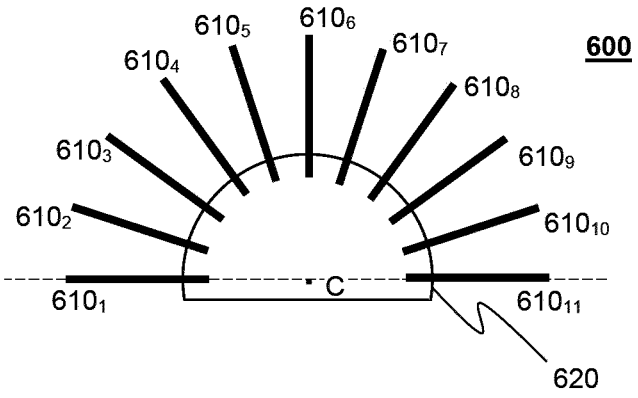
FIG. 6 shows a microphone array in a fourth embodiment.

Moreover, it may make sense for certain applications to arrange the directional microphones on a segment of a circle that has a certain angle, e.g., if only low levels of disturbing noise from the rear are to be expected. However, the disadvantage of a segmental arrangement as compared to a circular arrangement is that for a positioning near the edge, ambient noise from directions in which no directional microphone is pointed cannot be well suppressed. This problem can be compensated partially by making the segment larger than the region to be observed. FIG. 6 shows a microphone array 600 in a fourth embodiment, wherein again eleven directional microphones $\mathbf{610}_1, \ldots, \mathbf{610}_{11}$ are evenly distributed over a semicircle. For a central alignment near 0° corresponding to the microphone 6106 this arrangement works well. Also for a region of e.g. ±45° around the central alignment an acceptable result may be achievable. Correspondingly, a microphone array of a form as shown in FIG. 6 is usable e.g., at the corners of a playing field where a region or coverage range of substantially 90° is to be covered.

However, for segmental arrangements of directional microphones, other algorithms than modal beamforming are normally better suited, since they are not based on a circularly symmetrical arrangement of the microphones. But a disadvantage of such alternatively usable algorithms is that not only their scalar weightings but also their filtering functions are direction dependent. Since the calculation of filtering functions, or filter coefficients respectively, is often relatively computationally expensive, these may be calculated in advance. The device comprises then a memory in which the respective filtering coefficients for certain directions are stored and from which they can be retrieved if necessary. In this way, real-time operation is also possible with such alternative algorithms.

FIG. 7 shows a block diagram of a multi-focus signal processing for the beamforming algorithm. Like the single-focus signal processing already shown in FIG. 3, the multi-focus signal processing comprises a mixing matrix 310 for mixing the microphone signals into (2M+1) mixed signals, wherein M is the order of the common output signal, and a plurality of (2M+1) filters 320, 321, 321', 322, 322' for filtering the mixed signals, wherein filtered mixed signals $QF_{-M}, QF_{-M+1}, \ldots, QF_0, \ldots, QF_{M-1}, QF_M$ are generated. The filtered mixed signals are now provided not only to (2M+1) first weighting units $\mathbf{330}_1$, but also to (2M+1) second weighting units $\mathbf{330}_2$. The first weighting units $\mathbf{330}_1$ weight each of the filtered mixed signals with a first weighting $g_{-M}^{(\Phi_{T1})}, \ldots, g_0^{(\Phi_{T1})}, \ldots, g_M^{(\Phi_{T1})}$, and the second weighting units $\mathbf{330}_2$ weight each of the filtered mixed signals with a second weighting $g_{-M}^{(\Phi_{T2})}, \ldots, g_0^{(\Phi_{T2})}, \ldots, g_M^{(\Phi_{T2})}$. Each of the first weightings corresponds to the first preferred direction of high sensitivity 1' T1 and each of the second weightings corresponds to the second preferred direction of high sensitivity $\Phi_{T2}$. The output signals of the first weighting units $\mathbf{330}_1$ and the output signals of the second weighting units $\mathbf{330}_2$ are added up separately from each other in two separate summation units 3401, 3402, optionally filtered 3501, 3502 and then output. Accordingly, the microphone array has two preferred directions of high sensitivity, $\Phi_{T1}$, $\Phi_{T2}$ simultaneously. The two output signals 3601, 3602 comprise the audio signals from these two preferred directions of high sensitivity of the microphone array. E.g., noise coming from a ball and from a referee may simultaneously be extracted and recorded. An advantage of the arrangement is that the second weighting units $\mathbf{330}_2$ process the same filtered mixed signals as the first weighting units $\mathbf{330}_1$, using only different directional information for the preferred direction of high sensitivity $\Phi_{T2}$. Therefore, the filters 320, . . . , 322' need to be calculated and implemented only once, since they are direction independent. The weighting units may be implemented e.g., by multipliers. The entire arrangement shown in FIG. 3 or in FIG. 7 may be realized by one or more microprocessors, which may be configured by corresponding software programs.

Details of the two-dimensional modal beamforming will be explained hereinafter.

First, basic assumptions and relationships will be explained. In a compact area of interest in three-dimensional space that contains the center of a notional coordinate system, which is free of sound sources and which is excited from outside by a sound field which is independent of the coordinate system's z-axis, there is an array of Q acoustic sensors (i.e., microphones) that behave linearly. They are arranged on a circle within the x-y plane of the notional coordinate system, with the (two-dimensional) coordinates $$x_q = r_0 \cdot \begin{bmatrix} \cos(\phi_q) \\ \sin(\phi_q) \end{bmatrix}, \quad q \in \{1, Q\} \tag{1}$$

with $r_0$ being the radius of the circle and $\Phi_q$ being the azimuth angle of the q-th microphone, measured counter-clockwise in the x-y plane from the x-axis. The frequency domain representation $X(\omega, x_q)$ of the q-th microphone signal at an angular frequency $\omega$ may be expressed as a superimposition (or composition) of responses to individual plane waves impinging from all possible azimuth angles $\Phi$, i.e., $$X(\omega,x_q)=\int_{-\pi}^{\pi} H(\omega,x_q,\phi)\cdot C(\omega,\phi)d\phi \tag{2}$$

Here, $C(\omega,\Phi)$ denotes the so-called plane wave amplitude density function, which is basically a frequency domain representation of the sound pressure in the coordinate origin caused by a single plane wave incident from an azimuth angle $\Phi$. $H(\omega, x_q, \phi)$ indicates the directivity pattern of the q-th microphone.

By expanding the directivity pattern $H(\omega, x_q,\phi)$ and the plane wave amplitude density function $C(\omega, \phi)$ into series of real valued orthonormal Circular Harmonics (a special form of the Spherical Harmonics), defined by $$trg_m(\phi) = \sqrt{\frac{1}{2\pi}} \cdot \begin{cases} \sqrt{2}\cos(m\phi) & \text{for } m > 0 \\ 1 & \text{for } m = 0 \\ \sqrt{2}\sin(m\phi) & \text{for } m < 0 \end{cases} \tag{3}$$

according to $$H(\omega,x_q,\phi)=\Sigma_{m=-\infty}^{\infty} H_m(\omega,x_q)trg_m(\phi) \tag{4}$$

$$C(\omega,\phi)=\Sigma_{m=-\infty}^{\infty} C_m(\omega)trg_m(\phi) \tag{5}$$

and exploiting the orthonormality of the Circular Harmonics, i.e., $$\int_{-\pi}^{\pi} trg_m(\phi)trg_{m'}(\phi)d\phi=\delta_{m,m'} \tag{6}$$

where $\delta$, denotes the Kronecker delta function, the frequency domain microphone signal representation $X(\omega, x_q)$ can be reformulated as $$X(\omega, x_q) = \int_{-\pi}^{\pi} \sum_{m=-\infty}^{\infty} H_m(\omega, x_q)trg_m(\phi) \cdot \sum_{m'=-\infty}^{\infty} C_{m'}(\omega)trg_{m'}(\phi)d\phi \tag{7}$$

$$= \sum_{m=-\infty}^{\infty} H_m(\omega, x_q)C_m(\omega). \tag{8}$$

The individual weights $H_m(\omega, x_q)$ of the Circular Harmonics series in (4) are called the modal responses of degree m.

If all microphones have identical directivity patterns and face outwards or inwards perpendicular to the circle, this may be formally expressed as $$H(\omega,x_q,\phi)=H_{PROTO}(\omega,r_0,\phi-\phi_q) \tag{9}$$

with $H_{PROTO}(\omega, r_0, \phi)$ indicating a Φ-symmetric prototype directivity, which can be regarded as belonging to a microphone located at a position ($r_0$, $\phi_q$=0). Due to its Φ-symmetry, the Circular Harmonics expansion of $H_{PROTO}(\omega, r_0, \phi)$ is given by $$H_{PROTO}(\omega,r_0,\phi)=\Sigma_{m=-\infty}^{\infty}H_{PROTO,m}(\omega,r_0)trg_m(\phi) \tag{10}$$

with $$H_{PROTO,m}(\omega,r_0)=0 \text{ for } m<0. \tag{11}$$

For this special case, the modal responses can be factorized into a frequency and radius-dependent component and another component that only depends on the azimuth angle according to $$\boxed{H_m(\omega, x_q) = b_m(\omega, r_0)trg_m(\phi_q)} \tag{12}$$

with $$.b_m(\omega, r_0) = \begin{cases} \sqrt{\pi}\cdot H_{PROTO,m}(\omega, r_0) & \text{for } m > 0 \\ \sqrt{2\pi}\cdot H_{PROTO,0}(\omega, r_0) & \text{for } m = 0. \\ \sqrt{\pi}\cdot H_{PROTO,-m}(\omega, r_0) & \text{for } m < 0. \end{cases} \tag{13}$$

Further remarkable is the symmetry of the radial components $$b_m(\omega,r_0)=b_{-m}(\omega,r_0)\forall m \tag{14}$$

and the fact that the radial components depend on the product of the angular frequency and the radius:

$$b_m(\omega,r_0)=b_m(\omega r_0) \tag{14a}$$

By plugging (12) into (8), the frequency domain representation $X(\omega, x_q)$ of the q-th microphone signal may be express as $$X(\omega,x_q)=\Sigma_{m=-\infty}^{\infty}b_m(\omega,r_0)C_m(\omega)trg_m(\phi_q) \tag{15}$$

In the following, the basic principle of modal beamforming is described. It may be subdivided into the following two steps:

(1) reconstructing from the microphone signals $X(\omega, x_q)$ the underlying composition of the incident sound field of individual plane waves represented by the Circular Harmonics series expansion coefficients $C_m(\omega)$ of the plane wave amplitude density function, and (2) weighting the individual plane waves of the incident sound field according to a desired target beam pattern, and subsequently their integration in order to obtain the output signal of the beamformer.

A block diagram of a typical modal beamformer is shown in FIG. 3 and FIG. 7, as described above. The two mentioned steps will be described in more detail in the following.

To motivate the incident sound field reconstruction, the Circular Harmonics expansion of the frequency domain microphone signals $$X(\omega,x_q)=\Sigma_{m=-\infty}^{\infty}X_m(\omega,r_0)trg_m(\phi_q) \tag{16}$$

is compared with (15). It becomes clear that the expansion coefficients $X_m(\omega, r_0)$ are related to the desired Circular Harmonics series expansion coefficients $C_m(\omega)$ of the plane wave amplitude density function according to $$X_m(\omega,r_0)=b_m(\omega,r_0)C_m(\omega) \tag{17}$$

Therefore, two further steps are performed:

(1) The Circular Harmonics series expansion coefficients of the frequency domain microphone signals are estimated by a Circular Harmonics transform according to $$\hat{X}_m(\omega,r_0)=\Sigma_{q=1}^{Q}w_q\cdot X(\omega,x_q)\cdot trg_m(\phi_q) \tag{18}$$

Here, it is to be noted that due to the finite number Q of spatial sampling points $x_q$ the maximum absolute value of the degree m that can be reconstructed is also finite, and depends on the distribution of the spatial sampling points $x_q$ on the circle. For instance, for the special case of a uniform distribution, the weights are all equal, namely $$\frac{2\pi}{Q},$$

and the maximum absolute value of the degree m that can be reconstructed is given by $$\boxed{M = \left\lfloor \frac{Q-1}{2} \right\rfloor} \tag{19}$$

By defining the vector $X(\omega)$ containing the signals of all microphones by $$X(\omega)=[X(\omega,x_1)X(\omega,x_2)\ \ldots\ X(\omega,x_Q)]^T \tag{20}$$

the vector with all Circular Harmonics series expansion coefficients by $$X_{CH}(\omega,r_0)=[\hat{X}_{-M}(\omega,r_0)\hat{X}_{-M+1}(\omega,r_0)\ \ldots\ \hat{X}_M(\omega,r_0)]^T \tag{21}$$

and the discrete Circular Harmonics transformation matrix by $$T^{(M)}(\phi_1, \phi_2, \ldots, \phi_Q) = \begin{bmatrix} w_1\cdot trg_{-m}(\phi_1) & w_2\cdot trg_{-m}(\phi_2) & \ldots & w_Q\cdot trg_{-m}(\phi_Q) \\ w_1\cdot trg_{-M+1}(\phi_1) & w_2\cdot trg_{-M+1}(\phi_2) & \ldots & w_Q\cdot trg_{-M+1}(\phi_Q) \\ \vdots & \vdots & \ddots & \vdots \\ w_1\cdot trg_M(\phi_1) & w_2\cdot trg_M(\phi_2) & & w_Q\cdot trg_M(\phi_Q) \end{bmatrix} \tag{22}$$

the estimation of the Circular Harmonics series expansion coefficients may be expressed by the following matrix multiplication:

$$X_{CH}(\omega,r_0)=T^{(M)}(\phi_1,\phi_2,\ldots,\phi_Q)\cdot X(\omega) \tag{23}$$

Especially important is that this matrix is frequency independent.

(2) Considering (17) and (14), the Circular Harmonics series expansion coefficients of the plane wave amplitude density function are estimated in principle as follows:

$$\boxed{\hat{C}_m(\omega) = f_{|m|}(\omega, r_0)\cdot\hat{X}_m(\omega, r_0)} \tag{24}$$

with $$f_{|m|}(\omega, r_0) = \frac{1}{b_{|m|}(\omega, r_0)}, \tag{25}$$

which corresponds to a filtering operation for each individual estimated Circular Harmonics series expansion coefficient of the frequency domain microphone signals $\hat{X}_m(\omega, r_0)$ Using the estimated Circular Harmonics series expansion coefficients of the plane wave amplitude density function, the individual plane waves of the incident sound field are weighted according to a desired target beam pattern to be subsequently integrated, or summed up respectively.

The maximum degree M of the Circular Harmonics series expansion coefficients of the plane wave amplitude density function determines the maximum possible spatial resolution of the target beam pattern. Hence, a prototype of a desired target beam pattern is defined by means of a Circular Harmonics expansion truncated at the same maximum degree M:

$$g^{(\phi_T=0)}(\phi)=\Sigma_{m=0}^{M} g_m^{(\phi_T=0)}\cdot tr g_m(\phi) \quad (26)$$

which is steered towards a target azimuth angle $\phi_T=0$ and which is Φ-symmetric. Due to the symmetry, the expansion coefficients for negative degree indices m are zero.

If the target beam pattern is steered to an arbitrary target azimuth $\Phi_T$, its Circular Harmonics series expansion coefficients can be computed in dependence on those for $\phi_T=0$ according to $g_m^{(\Phi_T)}=\cos(m\phi_T)\cdot g_m^{(\Phi_T=0)}+\sin(m\phi_T)\cdot g_{-m}^{(\Phi_T=0)}$ $\forall m\in\{-M, \ldots, M\}$ (27)

The actual frequency domain output signal Y(w) of the beamformer is computed as weighted sum of Circular Harmonics series expansion coefficients of the plane wave amplitude density function as follows:

$$Y(\omega)=\Sigma_{m=-M}^{M} g_m^{(\Phi_T)}\hat{C}_m(\omega) \quad (28)$$

Due to the equivalence of (28) with $$Y(\omega)=\int_{-\pi}^{\pi} g^{(\Phi_T)}(\phi)C(\omega,\phi)d\phi \quad (29)$$

the integration of the weighted plane wave contributions to the incident sound field becomes evident.

For most applications, the frequency-invariant beam pattern used above is advantageous and desired. However, also a frequency dependent beam pattern can be created very easily by making the weighting factors frequency dependent. This requires a filter per individual Circular Harmonics series expansion coefficient of the plane wave amplitude density function before summation.

Optionally, an equalizing filter 350, 350' can be applied to the output signal Y(ω) of the beamformer to create a direction independent coloration, or compensate a direction dependent coloration respectively, e.g., to attenuate high frequency signal components affected by spatial aliasing.

The radius of the circle on which the microphone capsules of the directional microphones are arranged affects at least two parameters of the array, namely the practically realizable directivity for low frequencies and the frequency at which the spatial aliasing starts occurring.

Figure 8:
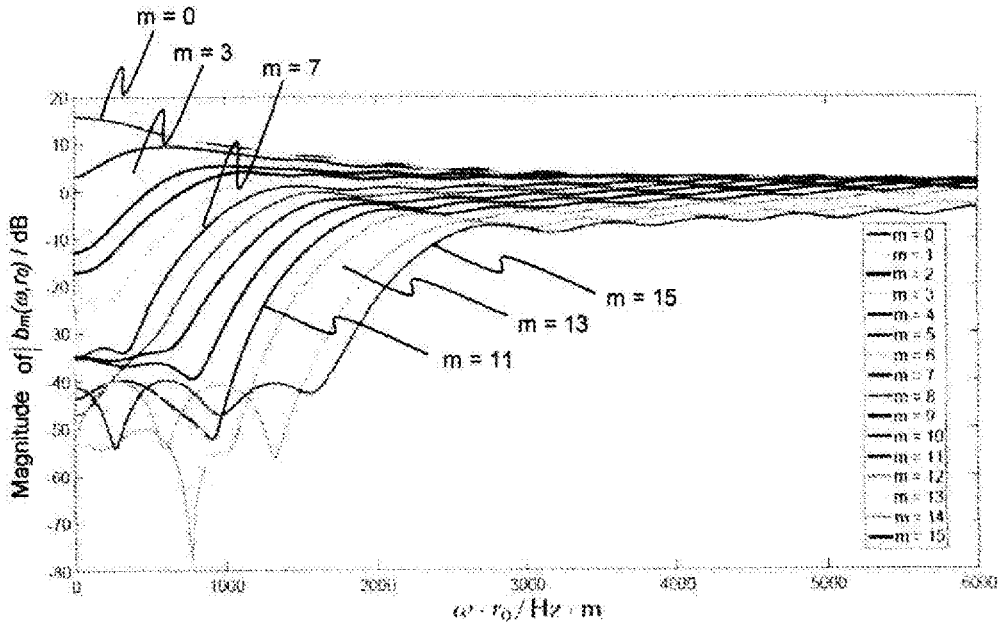
FIG. 8 shows a diagram of radial components of modal responses of a Sennheiser MKH8070 shotgun microphone.

The directivity at low frequencies is affected as follows. The radial components $b_m(\omega, r_0)$ of the modal responses typically have a high-pass characteristic, where the cutoff frequency increases with the degree index m. For illustration, FIG. 8 shows exemplarily a diagram of magnitudes of radial components of modal responses for various degrees m of a Sennheiser MKH8070 shotgun microphone, plotted over a product $\omega\cdot r_0$. As can be seen, the contributions of modes with increasing degree m within the measured microphone signals (16) become very small, in particular for low spectral frequencies. Hence, reconstructing the corresponding Circular Harmonics series expansion coefficients of the plane wave amplitude density function requires a high amplification factor of $$\frac{1}{b_{|m|}(\omega, r_0)}$$

(see (26), since $|b_{|m|}(\omega, r_0)|$ is small. This leads to a typically low white noise gain when using a target beam pattern of high degree m, which means that microphone noise is highly amplified within the beamformer output signal. By increasing the radius r of the array, the curves depicted in FIG. 8 substantially are shifted to the left, i.e., towards lower frequencies. This leads to a decrease of the high-pass cutoff frequencies and thereby reduces the effect of white noise amplification at low frequencies, compared to a smaller radius.

Spatial aliasing is a phenomenon that occurs e.g., when sampling a sound field with the sampling points being distributed too sparsely to capture high frequency spatial sound pressure oscillations. Since the relevance of Circular Harmonics with higher degree m within the signature function usually grows with spectral frequency, the same happens with the amount of error caused by the spatial aliasing. In particular, the angular frequency where the contribution of Circular Harmonics of degrees greater than M to the signature function becomes significant can be seen as the frequency where the aliasing error effects start to become disturbing, or notable respectively. Substantially, this angular frequency is $$\omega = \frac{M\cdot c_S}{r_0} \quad (30)$$

where cs denotes the speed of sound. This means that for a chosen number Q of microphones the spatial aliasing frequency may be increased by decreasing the array radius r. Alternatively, the number of microphones can be increased for a given array radius.

For microphone arrays for audible frequencies, the microphone capsules should be on a circle or circle segment with a radius of at least $r_{min}$=5 cm. For practical reasons, a maximum radius of about $r_{max}$=100 cm is advisable. For microphone arrays intended for usage in a sports stadium it is advantageous if for outwardly pointing shotgun microphones the radius is between $r_{min}$=30 cm and $r_{max}$=40 cm, and for inwardly pointing shotgun microphones e.g., between $r_{min}$=40 cm and $r_{max}$=60 cm. With the exemplarily described arrangement, a very high directivity e.g., for frequencies in the range of 200 Hz-3 kHz can be achieved. For recordings in a sports stadium, frequencies below 3-4 kHz are particularly relevant.

Figure 9:
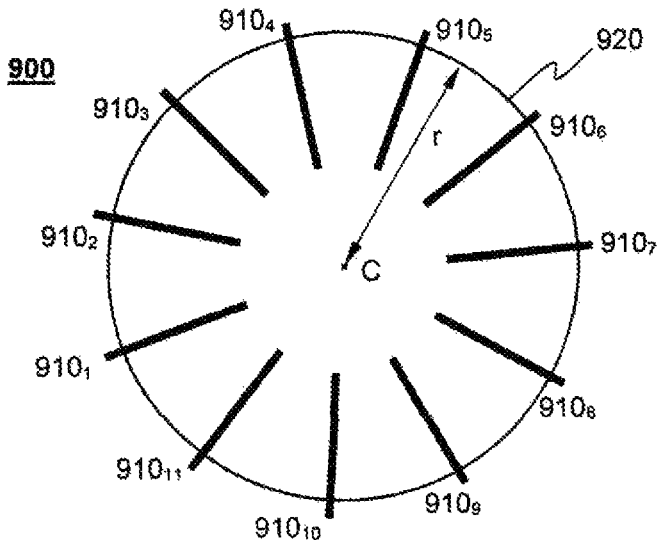
FIG. 9 shows a microphone array in a fifth embodiment.

A smaller construction of the microphone array is possible if the circular arranged shotgun microphones point radially inward. The above calculations continue to be valid in this case. FIG. 9 schematically shows, in a fifth embodiment, a microphone array 900 with eleven shotgun microphones with the individual shotgun microphones $\mathbf{910}_1, \ldots, \mathbf{910}_{11}$ being aligned substantially towards the center C of the array. The respective microphone capsules (not shown) are positioned on a circle 920 with the radius r. Using a radius of r=50 cm and e.g., Sennheiser MKH8070 shotgun microphones with a length of about 46.5 cm (wherein the microphone capsule is about 6 cm from the rear end), the diameter of the entire array is therefore only 2*(50+6) cm=112 cm instead of 2*(50+40.5) cm=181 cm.

Figure 10:
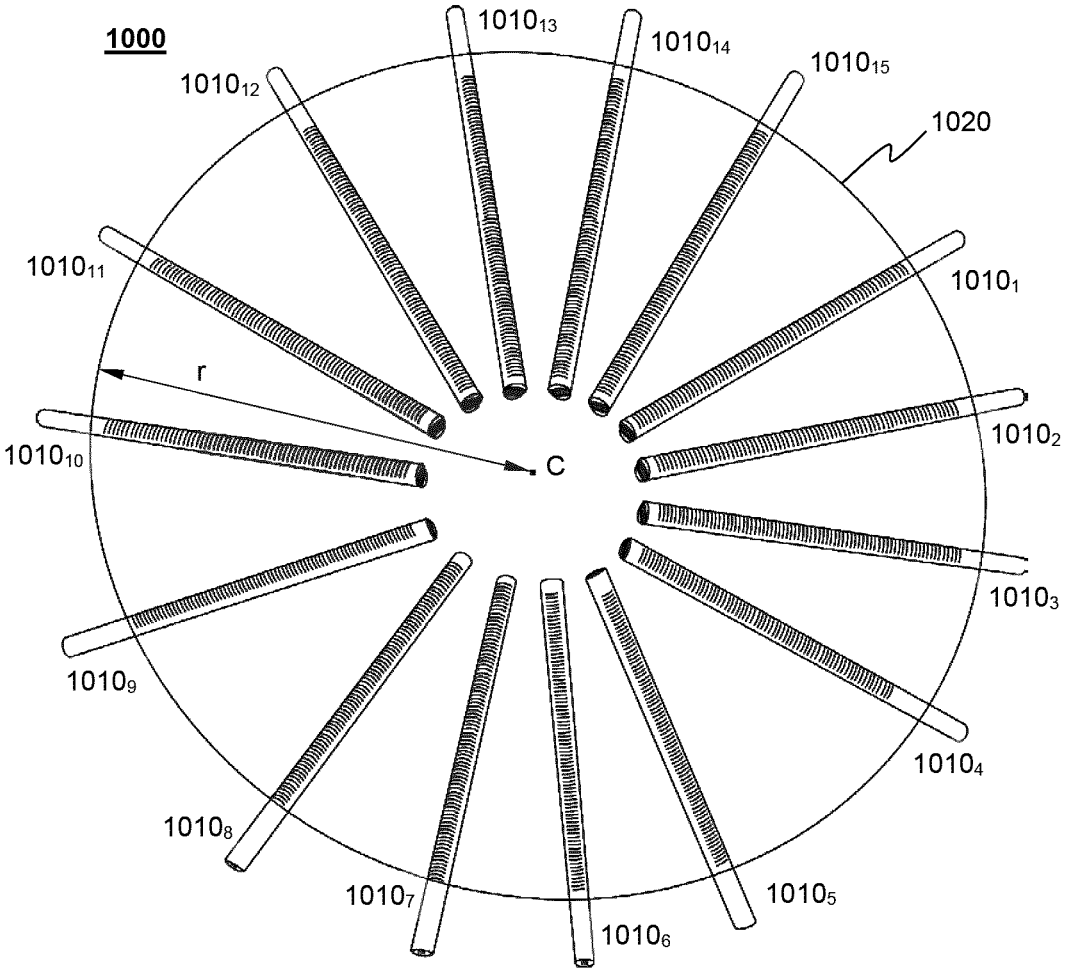
FIG. 10 shows a perspective view of a microphone array, in an embodiment.

FIG. 10 shows, in a further embodiment, a perspective view of a similar microphone array 1000 with fifteen shotgun microphones $\mathbf{1010}_1, \ldots, \mathbf{1010}_{15}$ that are also aligned towards the center C of the array. The microphones may be attached e.g., to a ring or a plate. It is particularly important to ensure that the lateral openings 220 of the interference tubes $\mathbf{1010}_1, \ldots, \mathbf{1010}_{15}$ must not be covered, since they are the most important sound entrance here. Thus, the shotgun microphones $\mathbf{1010}_1, \ldots \mathbf{1010}_{15}$ are not disturbed by the respective opposite shotgun microphone (i.e., in "view direction"). The shotgun microphones $\mathbf{1010}_1, \ldots, \mathbf{1010}_{15}$ are therefore arranged such that their upper sides with the lateral openings 220 are freely accessible to the sound and preferably all point into the same direction. As in the previously described examples, the shotgun microphones $\mathbf{1010}_1, \ldots, \mathbf{1010}_{15}$ are located substantially in one plane, wherein the directivity of the microphone array can be electronically steered within this plane. It is to be noted that the illustration in FIG. 10 is not necessarily true to scale. E.g., the microphones $\mathbf{1010}_1, \ldots, \mathbf{1010}_{15}$ should be distributed over the circle 1020 as evenly as possible.

A particular advantage of the microphone array according to the invention is that it needs not be moved but remains stationary, wherein the direction of maximum sensitivity can be adjusted by electronic control, in the case of the circular arrangement to any direction withing the plane of the circle (corresponding to an azimuth angle of 0°-360° in a horizontal setup). In other specific applications it may make sense to position the circle vertically in order to capture an elevation angle of 0°-360° while keeping the azimuth angle very small. Likewise, arbitrary orientations of the microphone plane are possible in between. As shown in the drawings, there is no microphone in the center of the arrangement. The mentioned respective number of shotgun microphones per array is the respective minimum number; it is always possible and may be advantageous to increase the number Q of microphones, as explained above. The number Q may be even or odd.

In an embodiment, the invention relates to a method for audio recording by means of a microphone array composed of directional microphones, wherein at least one common output signal is generated that comprises sound coming from an adjustable preferred direction of high sensitivity of the microphone array, with the steps: mixing a plurality of microphone signals in a mixing matrix to obtain (2M+1) mixed signals, wherein M is the order of the common output signal, and wherein the microphone signals come from the directional microphones and the directional microphones are arranged substantially in a plane and on a circle or segment of a circle, such that for each of the directional microphones a preferred direction of high sensitivity is substantially orthogonal outward or inward to the circle or circle segment; filtering the mixed signals in a plurality of (2M+1) filters, wherein filtered mixed signals are obtained, weighting each of the filtered mixed signals with a weighting in a plurality of (2M+1) weighting units, wherein the weighting of each weighting unit corresponds to the adjustable preferred direction of high sensitivity of the microphone array, and summing up the (2M+1) weighted filtered mixed signals in a summation unit, wherein the common output signal is obtained.

The embodiments described above are exemplary and may be combined with one another, even if such combination is not expressly mentioned. E.g., in an array arrangement as shown in FIG. 5, the individual directional microphones may point inwardly, as in FIG. 9 and FIG. 10.

The invention claimed is:

1. A microphone array comprising a plurality of microphones whose output signals are combined into at least one common output signal, wherein the microphones are directional microphones, each comprising a microphone capsule, an interference tube and a preferred direction of high sensitivity, the interference tube pointing in the preferred direction of high sensitivity;

the microphones are arranged substantially in one plane;

the microphones are arranged such that each microphone has a different preferred direction of high sensitivity;

the microphones are arranged such that their microphone capsules are positioned on a circle or segment of a circle and, for each of the microphones, the preferred direction of high sensitivity is substantially orthogonal to the circle or segment of the circle;

the common output signal is obtained by modal beamforming; and the microphone array has at least one adjustable preferred direction of high sensitivity, wherein the common output signal comprises the sound captured from this at least one adjustable direction, wherein a directivity of the microphone array in a dimension perpendicular to the plane of the microphones substantially corresponds to the directivity of a single directional microphone.

2. The microphone array according to claim 1, wherein the beamforming generates a beam pattern of the microphone array, the beam pattern being defined by a degree M, wherein a higher degree means a more focused beam pattern, and wherein the frequency-independent mixing matrix has (2M+1) outputs with $M \leq (Q-1)/2$, Q being the number of microphones.

3. The microphone array according to claim 1, further comprising an electronic circuit arrangement for processing the output signals of the microphones to perform the modal beamforming.

4. The microphone array according to claim 3, wherein the electronic circuit arrangement comprises at least the following elements:

a mixing matrix for mixing the microphone signals into (2M+1) mixed signals, with M being the order of the common output signal and $M \leq (Q-1)/2$, Q being the number of microphones;

a plurality of (2M+1) filters for filtering the mixed signals, wherein filtered mixed signals are generated, and wherein the filters perform a filtering that is adapted to the employed type of directional microphone;

a plurality of (2M+1) weighting units for weighting each of the filtered mixed signals with a weighting, wherein the weighting of each weighting unit corresponds to the adjustable preferred direction of high sensitivity of the microphone array; and a summation unit for summing up the (2M+1) weighted, filtered mixed signals, wherein an output signal is generated that comprises sound from the adjustable preferred direction of high sensitivity of the microphone array.

5. The microphone array according to claim 4, wherein the weighting units are first weighting units, and wherein the microphone array has at least two preferred directions of high sensitivity and wherein the electronic circuit arrangement comprises further weighting units and at least one further summation unit, wherein the second weighting units process the same filtered mixed signals as the first weighting units, but receive different directional information for the preferred direction of high sensitivity of the microphone array.

6. The microphone array according to claim 1, wherein the microphone capsules are arranged on a circle or segment of a circle with a radius of between $r_{min}$=5 cm and $r_{max}$=100 cm.

7. The microphone array according to claim 6, wherein the radius is between 30 cm and 60 cm.

8. The microphone array according to claim 1, further comprising a control unit for adjusting the preferred direction of high sensitivity of the microphone array or an input for connecting such control unit.

9. The microphone array according to claim 1, wherein for each of the microphones the preferred direction of high sensitivity points outwardly relative to the circle or segment of a circle.

10. The microphone array according to claim 1, wherein for each of the microphones the preferred direction of high sensitivity points inwardly relative to the circle or segment of a circle.

11. The microphone array according to claim 1, wherein the directional microphones are shotgun microphones.

12. A method for audio recording using a microphone array of directional microphones, wherein at least one common output signal is generated that comprises sound from an adjustable preferred direction of high sensitivity of the microphone array and being obtained through modal beamforming, and wherein each directional microphone comprises a microphone capsule and an interference tube pointing in a preferred direction of high sensitivity of the respective directional microphone, the method comprising:

mixing a plurality of microphone signals received from the directional microphones in a frequency-independent mixing matrix to obtain (2M+1) mixed signals, wherein M is the order of the common output signal, and wherein the directional microphones are arranged substantially in one plane such that the microphone capsules are arranged on a circle or segment of a circle and for each of the directional microphones the preferred direction of high sensitivity is substantially orthogonal to the circle or segment of a circle;

filtering the mixed signals in a plurality of (2M+1) filters, wherein filtered mixed signals are generated;

weighting each of the filtered mixed signals with a weighting in a plurality of (2M+1) weighting units, wherein the weighting of each weighting unit corresponds to the adjustable preferred direction of high sensitivity of the microphone array; and summing up the (2M+1) weighted, filtered mixed signals in a summation unit, wherein the common output signal is generated;

wherein a directional characteristic of the microphone array in a dimension perpendicular to the plane of the microphones corresponds substantially to the directional characteristic of a single directional microphone.

13. The method according to claim 12, further comprising:

detecting a change in an input signal, the input signal controlling the adjustable preferred direction of high sensitivity of the microphone array; and changing the preferred direction of high sensitivity of the microphone array according to the detected change.

14. The method according to claim 13, wherein the filtering function of each filter depends on radial components of modal responses of the employed type of microphones.

15. The microphone array according to claim 1, wherein a frequency-independent mixing matrix is used for the modal beamforming, and wherein output signals of the mixing matrix are filtered, weighted and summed up, wherein the filtering function of each filter depends on radial components of modal responses of the employed type of microphones.

* * * * *